US006122918A

United States Patent [19]

Johnson, Jr.

[11] Patent Number: 6,122,918

[45] Date of Patent: Sep. 26, 2000

[54] STORAGE CABINET FOR CIGARS

[75] Inventor: Stephen L. Johnson, Jr., Dhahran, Saudi Arabia

[73] Assignee: Odin Design Limited, Wilmington, Del.

[21] Appl. No.: 09/350,235

[22] Filed: Jul. 9, 1999

[51] Int. Cl.[7] ..... F25B 21/02

[52] U.S. Cl. ..... 62/3.6; 62/91

[58] Field of Search ..... 62/3.6, 3.7, 91

[56] References Cited

U.S. PATENT DOCUMENTS

| | | | |
|---|---|---|---|
| 1,137,752 | 5/1915 | Goldstein . | |
| 1,853,423 | 4/1932 | Harris . | |
| 1,971,405 | 8/1934 | Harris | 131/55 |
| 2,671,707 | 3/1954 | Lombard | 312/31 |
| 2,753,164 | 7/1956 | Miller | 261/15 |
| 4,090,370 | 5/1978 | Vaughan | 62/91 |
| 4,183,224 | 1/1980 | Rule, III et al. | 62/91 |
| 4,364,234 | 12/1982 | Reed | 62/3 |
| 4,435,025 | 3/1984 | Weintraub | 312/31 |
| 4,711,294 | 12/1987 | Jacobs et al. | 165/19 |
| 4,730,462 | 3/1988 | Rogers | 62/171 |
| 5,400,608 | 3/1995 | Steed et al. | 62/91 |
| 5,400,612 | 3/1995 | Hedges | 62/171 |
| 5,483,799 | 1/1996 | Dalto | 62/3.7 |
| 5,603,220 | 2/1997 | Seaman | 62/3.7 |
| 5,651,262 | 7/1997 | Pendergast | 62/176.4 |
| 5,741,444 | 4/1998 | Kasuli | 261/128 |
| 5,927,077 | 7/1999 | Hisai et al. | 62/3.3 |
| 5,975,288 | 11/1999 | Crowder et al. | 206/205 |
| 6,006,903 | 12/1999 | Milone | 206/204 |
| 6,021,642 | 2/2000 | Guinn | 62/3.6 |

*Primary Examiner*—William Doerrler
*Assistant Examiner*—Melvin Jones
*Attorney, Agent, or Firm*—Pauley Peterson Kinne & Fejer

[57] ABSTRACT

A storage cabinet suitable for storing cigars, wherein relative humidity and temperature levels in the cabinet are maintained within a programmed range. More specifically, an ideal relative humidity to temperature ratio is maintained within the cabinet. An indicator displays real-time temperature, relative humidity and/or moisture level of the interior of the cabinet. A temperature control system comprises thermoelectric chips, rather than compressors, to maintain the temperature inside the cabinet. A humidity control system comprises a water container and fans directed at the water container for distributing humidity throughout the cabinet.

In an alternate embodiment, a moisture level is programmed and maintained despite fluctuations in temperature and/or humidity within the cabinet.

31 Claims, 3 Drawing Sheets

STORAGE CABINET FOR CIGARS

FIELD OF THE INVENTION

The present invention is directed toward a storage cabinet suitable for storing cigars, wherein relative humidity and temperature levels in the cabinet are maintained within a programmed range.

BACKGROUND OF THE INVENTION

Temperature and relative humidity (RH) are important factors in the proper storage of cigars. Cigars ideally must be kept at a certain RH relative to temperature. RH of 70% at around 70° Fahrenheit is the ideal setting for the long-term preservation of cigars. If temperature increases, then in order to maintain the ideal relative humidity to temperature ratio, i.e., 70% to 70° Fahrenheit, the relative humidity will need to be reduced. Likewise, if temperature decreases, then in order to maintain the ideal relative humidity to temperature ratio, i.e., 70% to 70° Fahrenheit, the relative humidity will need to be increased.

Because warmer air holds more moisture than cooler air, the level of moisture is also a critical factor in the proper storage of cigars. The level of moisture which corresponds to 70% RH at 70° Fahrenheit would correspond to a lower RH at 80° Fahrenheit, for instance, and a higher RH at 60° Fahrenheit. Inconsistent moisture levels during storage can have detrimental effects on tobacco products. If a cigar is allowed to dry during storage, it will smoke too hot, too fast and will burn unevenly. However, if a cigar is stored in too much moisture it will be difficult to light and it will be difficult to draw air through the cigar. The maintenance of a proper RH to temperature ratio requires that temperature be maintained within an acceptable temperature range. Otherwise, temperature levels taken to an extreme would result in almost desert conditions at high temperatures, and at low temperatures even 100% RH would be insufficient. Furthermore, a constant level of moisture (i.e. constant grams of moisture per unit air volume) is a desirable storage condition.

Cigars are set apart from other tobacco products by their sensitive storage requirements. Cigars require a 65–75% RH level. As mentioned above, temperature also must be maintained within a certain range, otherwise the RH will not be accurate or effective. Ideally, cigars should be kept at or under 75° Fahrenheit; higher temperatures with 65–75% RH can possibly breed tobacco eating bugs. Therefore, humidors that distribute humidity via slowly heating water are unsuitable products because they introduce warm and moist conditions. A slightly cool temperature with proper RH is the ideal and safest way to preserve cigars for a long term.

SUMMARY OF THE INVENTION

The present invention discloses a system for maintaining ideal temperature and relative humidity (RH) conditions in a cigar storage cabinet. An electronic hygrometer and an electronic thermometer take constant humidity and temperature readings of the cabinet's interior. If more humidity is needed to keep RH within a programmed range, then fans located above a water reservoir within the cabinet are activated to create increased humidity. The fans turn off when proper RH is achieved. Similarly, two thermoelectric chips (TECs) with attached heat sinks operate to adjust the temperature within the cabinet.

It is therefore an object of the present invention to provide means for maintaining ideal temperature and relative humidity conditions in a cigar storage cabinet.

It is therefore an object of the present invention to provide means for maintaining an ideal relative humidity to temperature ratio in a cigar storage cabinet.

It is a further object of the present invention to provide a storage cabinet suitable for storing cigars wherein a temperature range can be programmed and maintained.

It is yet another object of the present invention to provide a storage cabinet suitable for storing cigars wherein a range of relative humidity can be programmed and maintained.

It is yet another object of the present invention to provide a storage cabinet suitable for storing cigars wherein a set moisture level can be programmed and maintained despite fluctuations in temperature and/or humidity within the cabinet.

It is yet another object of the present invention to provide a storage cabinet suitable for storing cigars wherein the cabinet comprises an indicator that displays real-time temperature, relative humidity and/or moisture level of the interior of the cabinet.

It is yet another object of the present invention to provide a storage cabinet suitable for storing cigars wherein the cabinet has a temperature control system comprising thermoelectric chips, heat sinks and cooling fans.

It is yet another object of the present invention to provide a storage cabinet suitable for storing cigars wherein the cabinet has a humidity control system comprising a water container and blowers.

The foregoing and other features and advantages of the invention will become further apparent from the following detailed description of the presently preferred embodiments, read in conjunction with the accompanying drawings.

DETAILED DESCRIPTION OF THE INVENTION

Figure 1:
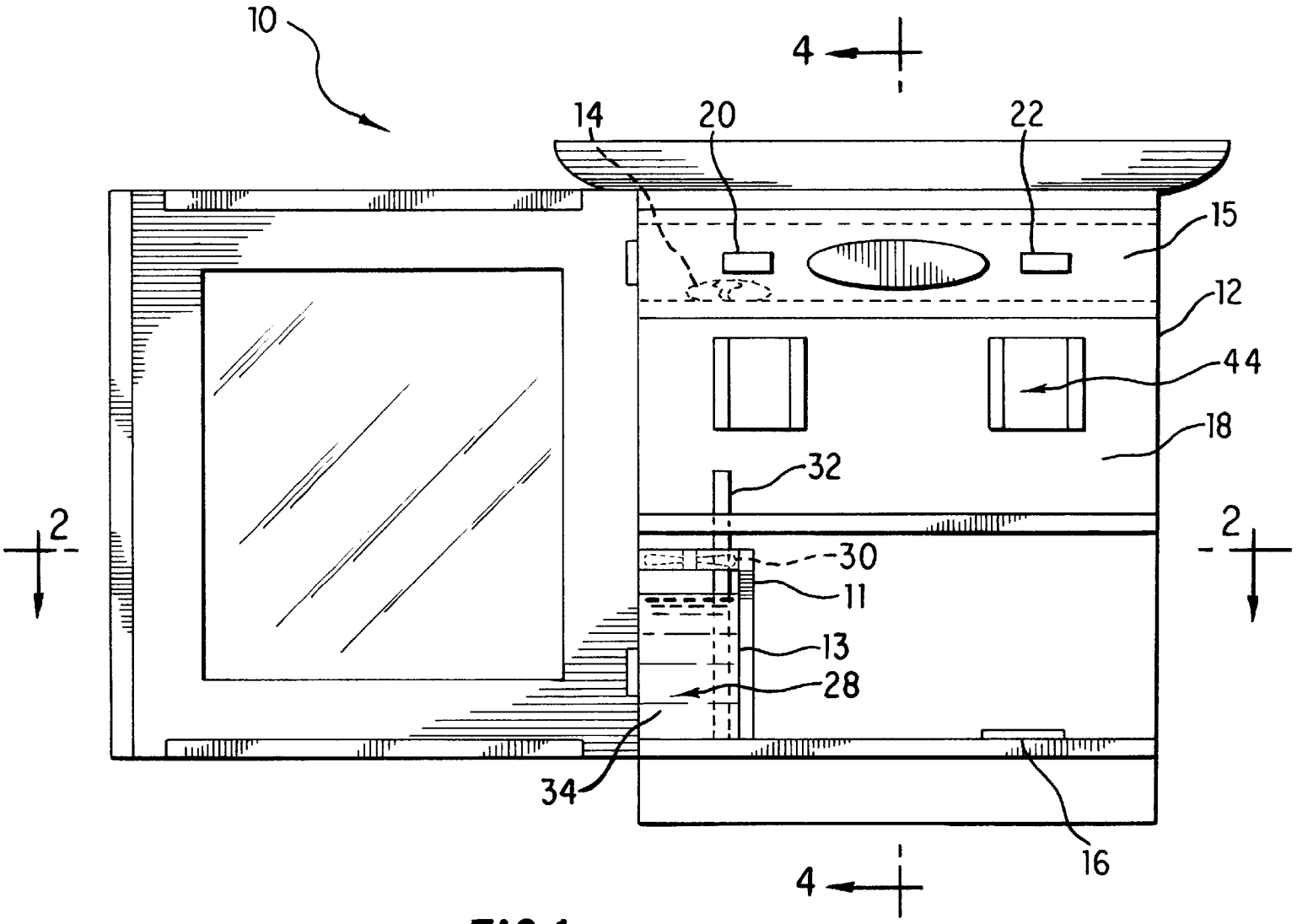
FIG. 1 is a front (internal) view of a cigar storage cabinet, according to a preferred embodiment of the invention.

Referring to FIG. 1, a storage cabinet 10 of the present invention comprises a case 12, preferably made of wood, for properly preserving cigars 14. The cigars 14 are stored in a drawer 15 within the cabinet 10 and in cigar boxes (not shown) which can be stacked in cabinet 10. A display board 16 mounted to the case 12 exhibits real-time temperature and relative humidity (RH) conditions within the cabinet 10. An electronic hygrometer 20 inside the cabinet 10 takes constant relative humidity readings of the cabinet's interior 18. Likewise, an electronic thermometer 22 inside the cabinet 10 takes constant temperature readings of the cabinet's interior 18. A main controller 24 (see FIG. 3) collects data from the hygrometer 20 and the thermometer 22 and processes and displays the data on the display board 16. The main controller 24 is preferably a Phillips® microchip.

A range of relative humidity level is programmed in the main controller 24. For storing cigars, a range of 65–75% RH is desirable, and a range of 70–73% RH is preferable. A humidity control system 26, shown in FIG. 2, operatively connected to the main controller 24, raises or lowers humidity within the cabinet 10 according to a need determined by the main controller 24 in view of the hygrometer reading 21.

The humidity control system 26, mounted inside the cabinet 10, comprises a water container 28, a fan 30 and a water level sensor 32. Preferably, the humidity control system 26 comprises a stainless steel water container, two axial flow fans (3.25") and a plurality of water level sensors. Water 34 is held in the water container 28 for increasing humidity within the cabinet 10. When the hygrometer 20 detects RH below the programmed RH, the main controller 24 transmits an electrical impulse to activate the fans 30. The fans 30, located above the water container 28, rapidly distribute water vapors throughout the cabinet 10 by blowing air into water container 28, creating humid air that flows into cabinet 10 via side air vents 11 in wall 13 of container 28, thereby controlling humidity within the cabinet 10. The fans 30 shut off when the cabinet 10 has sufficient humidity, as determined by the main controller 24 in view of the hygrometer reading 21. The humidity control system 26 further comprises a manual humidity adjustment knob 36 for manually setting humidity levels between about 65–75% RH, preferably about 70–73% RH. Additionally, water level sensors 32 are located inside the water container 28 in order to detect a need for adding water 34 to the water container 28. The water level sensors 32 are operatively connected to the main controller 24 which collects and processes data from the sensors 32, subsequently displaying water level status on the display board 16. Water (including returned condensation) may be added via a water line 33.

The main controller 24 is programmed for humidity priority. Humidity is first adjusted to the desired level. Once this is achieved, the main controller 24 adjusts the temperature to the desired level.

A temperature range is also programmed in the main controller 24. A temperature range not exceeding 75° Fahrenheit is desirable for storing cigars. An ideal relative humidity to temperature ratio is achieved when the relative humidity is in a range of 70–73% and the temperature is in a range of 50–72° Fahrenheit.

Figure 2:
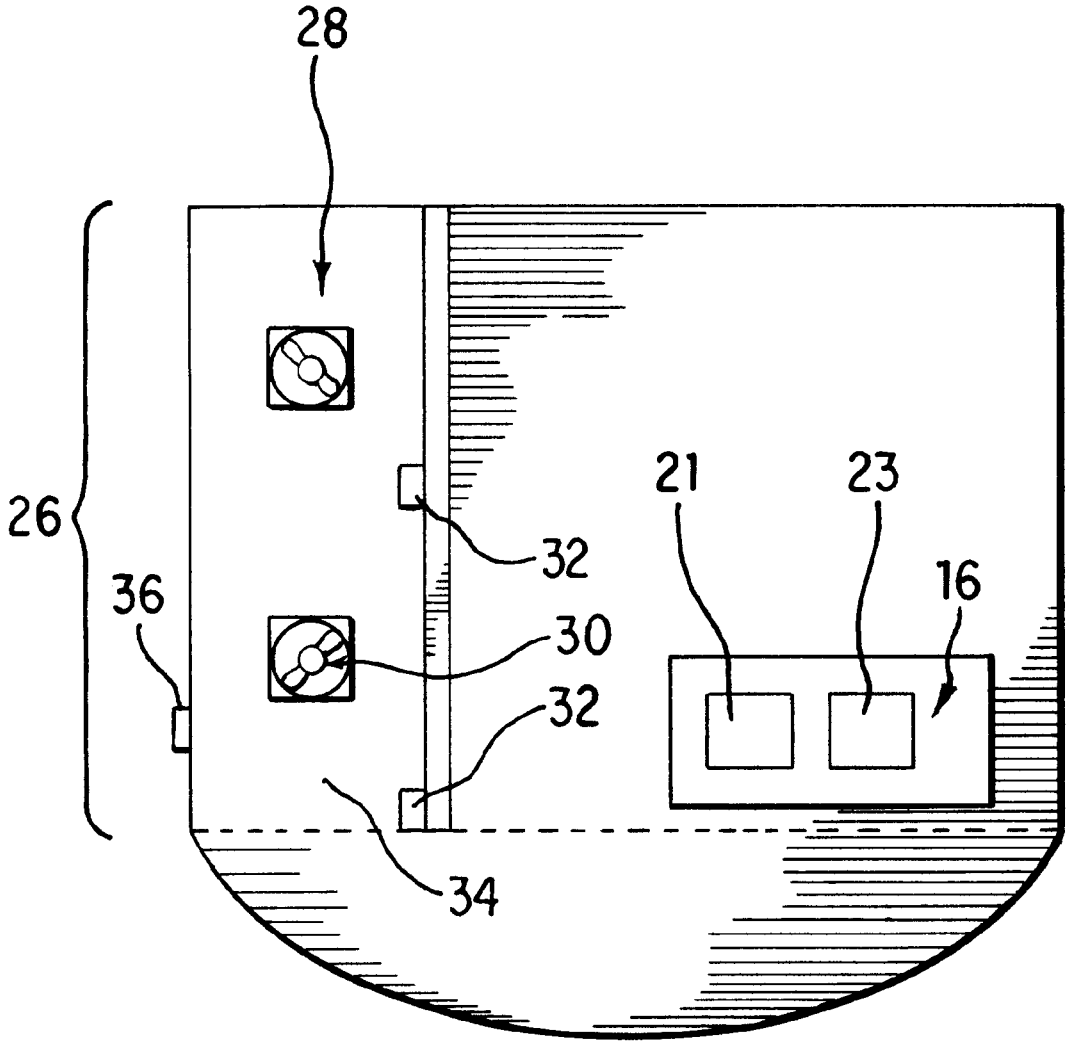
FIG. 2 is a cross-section view of the cabinet shown in FIG. 1 taken at line A—A.
Figure 3:
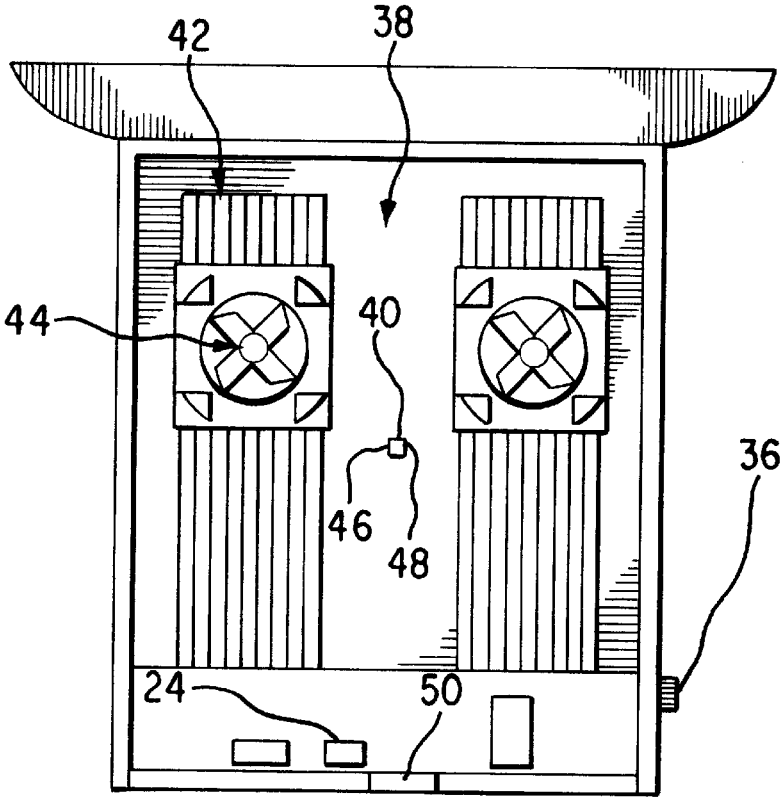
FIG. 3 is a back (internal) view of the cabinet shown in FIG. 1.

A temperature control system 38, shown in FIG. 3, operatively connected to the main controller 24, raises or lowers temperature within the cabinet 10 according to a need determined by the main controller 24 in view of the thermometer reading 23 (FIG. 2).

The temperature control system 38, mounted inside the cabinet 10, comprises at least one thermoelectric chip (TEC) 40, at least one heat sink 42, and air circulation means 44. The TEC 40 comprises a hot side 46 and a cold side 48. Preferably, the temperature control system 38 comprises two TECs 40, two heat sinks 42 (5"×20") for the hot sides 46 of the TECs, two micro heat sinks 42 (2.25"×2.25") for the cold sides 48 of the TECs, two axial flow fans 44 (4.75") for the hot sides 46 of the TECs and two axial flow fans 44 (2.25") for the cold sides 48 of the TECs. The TECs may heat or cool the internal cabinet to within about 10° F. above or below the outside ambient temperature. Thus, the TECs are effective at ambient temperatures of 55–85° F., to maintain the cabinet temperature within the desired range of 65–75° F.

As a result of the thermometer reading 23, the main controller 24 activates the TECs 40 via electrical current to control temperature within the cabinet 10. The heat sinks 42 at the hot sides 46 distribute heat dissipated by the TEC 40. The fans 44 on the hot sides 46 cool down the heat sinks 42 and increase heat distribution. The fans 44 on the hot sides 46 also promote further cooling of the cold sides 48 of the TEC 40. The heat sinks 42 at the cold sides 48 distribute coolness from the TEC 40 into surrounding air. The fans 44 on the cold sides 48 scatter cold air through various areas within the cabinet 10.

Figure 4:
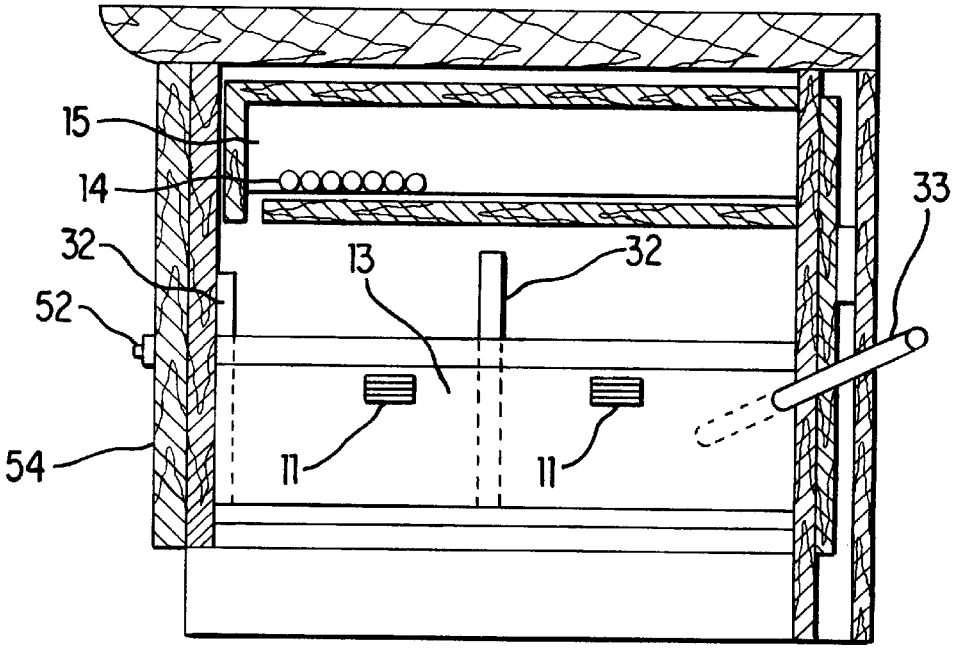
FIG. 4 is a cross-section view of the cabinet shown in FIG. 1 taken at line B—B.

A power supply 50, operatively attached to the main controller 24, display board 16, sensors 32, temperature control system 38 and humidity control system 26, is preferably mounted under the case 12. A lock 52 is installed in at least one location on the exterior 54 of the case to prevent others from gaining access to any contents in the cabinet 10, as shown in FIG. 4.

In an alternate embodiment of the invention, a moisture level is programmed in the main controller 24 as measured by the water level sensors 32. Because warmer air holds more moisture than cooler air, as temperature fluctuates within the cabinet 10, the humidity control system 26 raises or lowers humidity within the cabinet 10 to maintain a constant moisture level. A temperature range can also be programmed in the main controller 24 in this embodiment. The temperature range is achieved through the temperature control system 38.

While the embodiments disclosed herein are presently preferred, various modifications and improvements can be made without departing from the spirit and scope of the invention. The scope of the invention is indicated by the appended claims, and all changes that fall within the meaning and range of equivalency are intended to be embraced therein.

I claim:

1. Apparatus for maintaining an ideal relative humidity to temperature ratio within a storage cabinet for storing cigars, the apparatus comprising:

a case;

a display board mounted to the case;

an electronic hygrometer located inside the case;

an electronic thermometer located inside the case;

a programmable main controller operatively connected to the hygrometer, the thermometer and the display board, wherein the main controller collects data from the hygrometer and the thermometer, processes the data, and displays the data on the display board;

a humidity control system operatively connected to the main controller, wherein the humidity control system adjusts the relative humidity of air within the case according to a need communicated by the main controller; and a temperature control system operatively connected to the main controller, wherein the temperature control system adjusts the temperature of air within the case according to a need communicated by the main controller.

2. The apparatus of claim 1 wherein the main controller is programmed to maintain a relative humidity level in a 65–75% range.

3. The apparatus of claim 1 wherein the main controller is programmed to maintain a temperature in a range not exceeding 75° Fahrenheit.

4. The apparatus of claim 1 wherein the humidity control system comprises:

a water container;

at least one fan located in close proximity to the water container; and at least one water level sensor, located inside the case, operatively connected to the main controller.

5. The apparatus of claim 1 wherein the humidity control system comprises:

a stainless steel water container;

two axial flow fans located in close proximity to the water container; and a plurality of water level sensors, located inside the case, operatively connected to the main controller.

6. The apparatus of claim 1 wherein the temperature control system comprises:

at least one thermoelectric chip operatively connected to and activated by the main controller;

at least one heat sink attached to the at least one thermoelectric chip; and air circulation means.

7. The apparatus of claim 1 wherein the temperature control system comprises:

two thermoelectric chips operatively connected to and activated by the main controller, wherein each thermoelectric chip has a hot side and a cold side;

two heat sinks, each attached to the hot side of one of the thermoelectric chips;

two micro heat sinks, each attached to the cold side of one of the thermoelectric chips;

two axial flow fans, each in close proximity to the hot side of one of the thermoelectric chips; and two axial flow fans, each in close proximity to the cold side of one of the thermoelectric chips.

8. The apparatus of claim 1 further comprising a power supply mounted under the case and operatively attached to the main controller, the display board, the thermometer, the hygrometer, the temperature control system and the humidity control system.

9. The apparatus of claim 1 wherein the case is constructed primarily of wood.

10. The apparatus of claim 1 further comprising a lock installed on the case.

11. Apparatus for maintaining an ideal relative humidity to temperature ratio within a storage cabinet for storing cigars, the apparatus comprising:

a case;

an electronic hygrometer located inside the case;

an electronic thermometer located inside the case;

a programmable main controller operatively connected to the hygrometer and the thermometer, wherein the main controller collects and processes data from the hygrometer and the thermometer;

a humidity control system, operatively connected to the main controller, and comprising a water container and two axial flow fans located in close proximity to the water container; and a temperature control system, operatively connected to the main controller and comprising at least one thermoelectric chip operatively connected to and activated by the main controller; at least one heat sink attached to the at least one thermoelectric chip; and air circulation means.

12. The apparatus of claim 11 further comprising a display board mounted to the case and operatively connected to the main controller.

13. The apparatus of claim 11 wherein the main controller is programmed to maintain a relative humidity level in a 65–75% range.

14. The apparatus of claim 11 wherein the main controller is programmed to maintain a temperature in a range not exceeding 75° F.

15. The apparatus of claim 12 further comprising at least one water level sensor, located inside the case, operatively connected to the main controller, wherein the main controller collects and processes data from the at least one water level sensor and subsequently displays water level status of the water container on the display board.

16. The apparatus of claim 11 wherein the temperature control system comprises:

two thermoelectric chips, wherein each thermoelectric chip has a hot side and a cold side;

two heat sinks, each attached to the hot side of one of the thermoelectric chips;

two micro heat sinks, each attached to the cold side of one of the thermoelectric chips;

two axial flow fans, each in close proximity to the hot side of one of the thermoelectric chips; and two axial flow fans, each in close proximity to the cold side of one of the thermoelectric chips.

17. The apparatus of claim 11 further comprising a power supply mounted under the case and operatively attached to the main controller, the thermometer, the hygrometer, the temperature control system and the humidity control system.

18. The apparatus of claim 11 wherein the water container is constructed primarily of stainless steel.

19. The apparatus of claim 11 wherein the case is constructed primarily of wood.

20. The apparatus of claim 11 further comprising a lock installed on the case.

21. Apparatus for maintaining a constant moisture level within a storage cabinet, the apparatus comprising:

a case;

an electronic hygrometer located inside the case;

an electronic thermometer located inside the case;

at least one water level sensor located inside the case;

a programmable main controller operatively connected to the hygrometer, the thermometer and the at least one water level sensor, wherein the main controller collects and processes data from the hygrometer, the thermometer and the at least one water level sensor;

a humidity control system operatively connected to the main controller, wherein the humidity control system adjusts relative humidity of air within the case according to a need communicated by the main controller; and a temperature control system operatively connected to the main controller, wherein the temperature control system adjusts temperature of air within the case according to a need communicated by the main controller.

22. The apparatus of claim 21 further comprising a display board mounted to the case and operatively connected to the main controller.

23. The apparatus of claim 21 further comprising an adjustable temperature setting in the main controller.

24. The apparatus of claim 21 wherein the main controller is programmed to maintain a temperature in a range not exceeding 75° F.

25. The apparatus of claim 21 wherein the humidity control system comprises:

a water container; and at least one fan located in close proximity to the water container.

26. The apparatus of claim 21 wherein the humidity control system comprises:

a stainless steel water container; and two axial flow fans located in close proximity to the water container.

27. The apparatus of claim 21 wherein the temperature control system comprises:

at least one thermoelectric chip operatively connected to and activated by the main controller;

at least one heat sink attached to the at least one thermoelectric chip; and air circulation means.

28. The apparatus of claim 21 wherein the temperature control system comprises:

two thermoelectric chips operatively connected to and activated by the main controller, wherein each thermoelectric chip has a hot side and a cold side;

two heat sinks, each attached to the hot side of one of the thermoelectric chips;

two micro heat sinks, each attached to the cold side of one of the thermoelectric chips;

two axial flow fans, each in close proximity to the hot side of one of the thermoelectric chips; and two axial flow fans, each in close proximity to the cold side of one of the thermoelectric chips.

29. The apparatus of claim 21 further comprising a power supply mounted under the case and operatively attached to the main controller, the thermometer, the hygrometer, the temperature control system and the humidity control system.

30. The apparatus of claim 21 wherein the case is constructed primarily of wood.

31. The apparatus of claim 21 further comprising a lock installed on the case.

* * * * *